US010270227B2

(12) United States Patent
Hasegawa et al.

(10) Patent No.: US 10,270,227 B2
(45) Date of Patent: Apr. 23, 2019

(54) IGNITION PLUG

(71) Applicant: NGK SPARK PLUG CO., LTD., Nagoya-shi, Aichi (JP)

(72) Inventors: Yukinobu Hasegawa, Nagoya (JP); Yasushi Sakakura, Ichinomiya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/062,357

(22) PCT Filed: Oct. 11, 2016

(86) PCT No.: PCT/JP2016/004542

§ 371 (c)(1),
(2) Date: Jun. 14, 2018

(87) PCT Pub. No.: WO2017/104097

PCT Pub. Date: Jun. 22, 2017

(65) Prior Publication Data

US 2018/0375300 A1 Dec. 27, 2018

(30) Foreign Application Priority Data

Dec. 16, 2015 (JP) ..... 2015-245619

(51) Int. Cl.

| | |
|---|---|
| ***H01T 13/39*** | (2006.01) |
| ***H01T 21/02*** | (2006.01) |
| ***H01T 13/32*** | (2006.01) |
| *C22C 5/04* | (2006.01) |

(52) U.S. Cl.
CPC ..... *H01T 13/39* (2013.01); *H01T 13/32* (2013.01); *H01T 21/02* (2013.01); *C22C 5/04* (2013.01)

(58) Field of Classification Search
CPC ..... H01T 13/39; H01T 21/02; H01T 13/32; C22C 5/04
See application file for complete search history.

(56) References Cited

U.S. PATENT DOCUMENTS

2002/0130603 A1 9/2002 Teramura et al.
2018/0323584 A1* 11/2018 Igarashi ..... H01T 13/20

FOREIGN PATENT DOCUMENTS

JP S62-268079 11/1987
JP 2002-280145 9/2002

OTHER PUBLICATIONS

International Search Report from corresponding International Patent Application No. PCT/JP16/04542, dated Nov. 22, 2016.

* cited by examiner

*Primary Examiner* — Kevin Quarterman
(74) *Attorney, Agent, or Firm* — Kusner and Jaffe

(57) ABSTRACT

An ignition plug includes a ground electrode tip disposed in through hole through a ground electrode base material, a discharge surface of the ground electrode tip being exposed to the center electrode side from the through hole; and a fixing member disposed in the through hole at a part on a second direction side with respect to the large diameter surface.

18 Claims, 7 Drawing Sheets

FIRST EMBODIMENT

FIRST EMBODIMENT

SECOND EMBODIMENT

IGNITION PLUG

RELATED APPLICATIONS

This application is a National Stage of International Application No. PCT/JP16/04542 filed Oct. 11, 2016, which claims the benefit of Japanese Patent Application No. 2015-245619, filed Dec. 16, 2015, the entire contents of which are incorporated herein by reference.

FIELD OF THE INVENTION

The present invention relates to an ignition plug for igniting a fuel gas in an internal combustion engine.

BACKGROUND OF THE INVENTION

Conventionally, an ignition plug has been used in an internal combustion engine. An ignition plug has a ground electrode that forms a gap. As a ground electrode, an electrode having a ground electrode base material, and a ground electrode tip formed of noble metal that is fixed to the ground electrode base material has been used. For example, Japanese Patent Application Laid-Open (kokai) No. S62-268079 discloses a technique of providing a front end portion of a ground electrode base material with a hole for tip fixation, and disposing a ground electrode tip in the hole for tip fixation. In this technique, the ground electrode tip is fixed to the ground electrode base material by disposing a fixing member on the side opposite to the discharge surface of the ground electrode tip in the hole for tip fixation, and fixing the fixing member to the ground electrode base material.

However, it cannot be said that a sufficient device has been made, in the above-described technique, for the detailed structure for fixation of the fixing member to the ground electrode base material. Therefore, it has been impossible to fix the fixing member to the ground electrode base material with a sufficient strength, and there has been a possibility that the ground electrode tip falls off from the ground electrode base material.

The present specification discloses a technique of preventing a ground electrode tip from falling off from a ground electrode base material by improving the strength with which a fixing member is fixed to the ground electrode base material, in an ignition plug including the fixing member that fixes the ground electrode tip to the ground electrode base material.

SUMMARY OF THE INVENTION

A technique disclosed in the present specification can be embodied in the following application examples.

Application Example 1

In accordance with a first aspect of the present invention, there is provided an ignition plug comprising:

a center electrode;

a ground electrode base material having a first surface facing the center electrode and a second surface which is a reverse face of the first surface, and having a through hole which penetrates from the first surface to the second surface, the through hole having a first diameter in the first surface and a second diameter in the second surface that is larger than the first surface;

a ground electrode tip forming a gap between the ground electrode tip and the center electrode, having a discharge surface which has a diameter smaller than the first diameter, having a large diameter surface which has a diameter larger than the first diameter and smaller than the second diameter and which is a reverse face of the discharge surface, having a part including the large diameter surface disposed in the through hole, the discharge surface being exposed to the center electrode side from the through hole; and a fixing member disposed in the through hole at a part on a second direction side with respect to the large diameter surface when the direction from the large diameter surface to the discharge surface is defined as a first direction and an opposite direction thereto is defined as the second direction, wherein the ground electrode tip is held by an inner surface of the ground electrode base material, the inner surface forming the through hole, and by a surface on the first direction side of the fixing member, a maximum length along the first direction of a part of the fixing member, the part being disposed in the through hole, is not less than 50% of a maximum length along the first direction of a part of the ground electrode base material, the part having the through hole formed therein, a melt portion is provided in such a manner that it extends over the ground electrode base material and the fixing member in a cross section which passes through the central axis of the fixing member and extends along the first direction, and in the cross section, a length along the first direction from an end, at the first direction side, of the melt portion in a boundary between the ground electrode base material and the fixing member to the second surface is not less than 50% of the maximum length along the first direction of the part of the fixing member, the part being disposed in the through hole.

According to the above-described structure, the maximum length along the first direction of the part of the fixing member, the part being disposed in the through hole, is not less than 50% of the maximum length along the first direction of the ground electrode base material, and the length along the first direction from the end, at the first direction side, of the melt portion in the boundary between the ground electrode base material and the fixing member to the second surface of the ground electrode base material is not less than 50% of the maximum length along the first direction of the part of the fixing member, the part being disposed in the through hole. Therefore, the length along the first direction of the melt portion can be sufficiently secured, and it is possible to improve the strength with which the fixing member is fixed to the ground electrode base material. Therefore, it is possible to prevent the ground electrode tip from falling off from the ground electrode base material.

Application Example 2

In accordance with a second aspect of the present invention, there is provided an ignition plug according to application example 1, wherein the ground electrode tip has a tip body which includes the discharge surface, and a flange portion which has a diameter larger than that of the tip body, which is located at the second direction side with respect to the tip body, and which includes the large diameter surface, the through hole includes a small diameter portion which has a diameter larger than that of the discharge surface and smaller than that of the flange portion, and a large diameter portion which is located at the second direction side with respect to the small diameter portion and which has a diameter larger than that of the flange portion, the ground electrode base material has a step portion formed between the small diameter portion and the large diameter portion in the through hole, and a surface at the first direction side of the flange portion is supported by the step portion.

According to the above-described structure, since the surface at the first direction side of the flange portion is supported by the step portion, it is possible to improve the strength with which the ground electrode tip is fixed to the ground electrode base material. Further, it is possible to suppress fluctuation of the gap, during use of the ignition plug, formed between the discharge surface of the ground electrode tip and the center electrode.

Application Example 3

In accordance with a third aspect of the present invention, there is provided an ignition plug according to application example 2, wherein a percentage of a diameter of an end, in the second direction, of the tip body relative to a diameter of the flange portion is not less than 76% and not more than 95%.

According to the above-described structure, since the percentage of the diameter of the end, in the second direction, of the tip body relative to the diameter of the flange portion is not less than 76%, the diameter of the discharge surface is secured, and thus the wear resistance can be improved. Meanwhile, since the percentage of the diameter of the end, in the second direction, of the tip body relative to the diameter of the flange portion is not more than 95%, the width in the radial direction of the flange portion is secured, and thus the strength with which the ground electrode tip is fixed to the ground electrode base material can be further improved.

Application Example 4

In accordance with a fourth aspect of the present invention, there is provided an ignition plug according to any one of application examples 1 to 3, having an insulator configured to hold the center electrode, and a metal shell disposed around the insulator in a radial direction thereof, wherein the ground electrode base material has a connection end that is connected to the metal shell, and the melt portion at a position that intersects with a virtual line extending in a direction from the center of the ground electrode tip toward the connection end reaches the ground electrode tip.

Since at the connection end side of the ground electrode base material, the connection end is connected to the metal shell, the heat transfer performance is good. According to the above-described structure, the melt portion at a position that intersects with the virtual line extending in the direction toward the connection end reaches the ground electrode tip. Therefore, it is possible to further improve the heat transfer performance to the connection end side of the ground electrode base material from the ground electrode tip that has been heated to a high temperature by a spark or a fuel gas ignited by the spark.

Application Example 5

In accordance with a fifth aspect of the present invention, there is provided an ignition plug according to application example 4, wherein the ground electrode base material has a free end at a side opposite to the connection end, which is not connected with the metal shell, and the melt portion at a position that intersects with a virtual line extending in a direction from the center of the ground electrode tip to the free end does not reach the ground electrode tip.

At the free end side of the ground electrode base material, since the free end is not connected to the metal shell, the heat transfer performance is poor and the temperature tends to become high. If the melt portion near the free end that tends to have high temperature reaches the ground electrode tip, a crack is likely to occur in the melt portion by heat stress. According to the above-described structure, since the melt portion at a position that intersects with the virtual line extending in the direction toward the free end does not reach the ground electrode tip, it is possible to prevent a crack from occurring in the melt portion due to heat stress.

Application Example 6

In accordance with a sixth aspect of the present invention, there is provided an ignition plug according to any one of application examples 1 to 5, wherein the ground electrode tip is either one of iridium, and an iridium alloy.

It is noted that the technique disclosed in the present specification can be implemented in various forms. For example, the technique may be implemented as an ignition plug, an ignition device using the ignition plug, an internal combustion engine to which the ignition plug is mounted, and an internal combustion engine to which the ignition device using the ignition plug is mounted, and the like.

DETAILED DESCRIPTION OF THE INVENTION

A. First Embodiment

Figure 1:
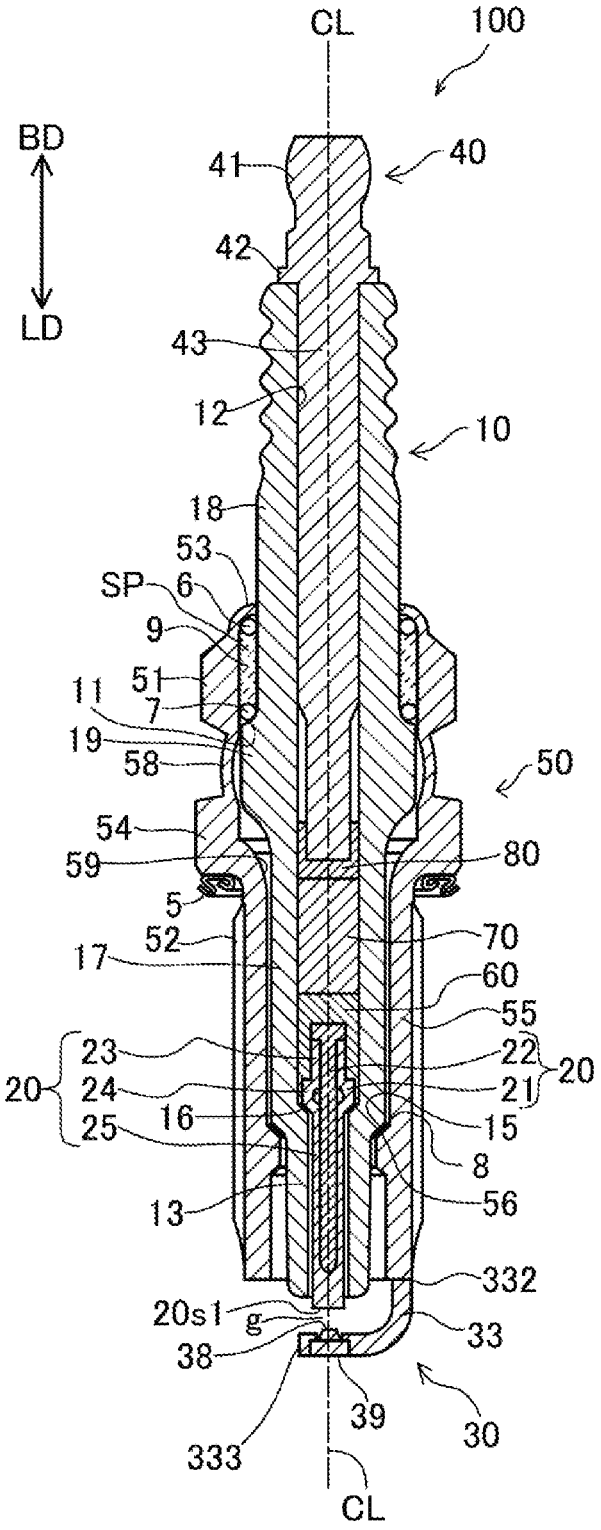
FIG. 1 is a cross-sectional view of an example of an ignition plug of a first embodiment.

A-1. Structure of Ignition Plug:

FIG. 1 is a cross-sectional view of an example of an ignition plug of a first embodiment. A line CL illustrated in the drawing indicates an axial line CL (also referred to as a central axis Cl) of an ignition plug 100. The illustrated cross section is a cross section including the axial line CL. Hereinafter, the direction parallel with the axial line CL is also referred to as "axial direction". Among the directions that are parallel with the axial line CL, the downward direction in FIG. 1 is referred to as a front end direction LD, and the upward direction is referred to as a rear end direction BD. The front end direction LD is a direction from a metal terminal 40 toward electrodes 20 and 30 that will be described later. A radial direction of a circle, around the axial line CL, on a plane perpendicular to the axial line CL is simply referred to as "radial direction", and the circumferential direction of the circle is simply referred to as "circumferential direction". The end in the front end direction LD is simply referred to as a front end, and the end in the rear end direction BD is simply referred to as a rear end.

The ignition plug 100 includes an insulator 10, the center electrode 20, the ground electrode 30, the metal terminal 40, a metal shell 50, a conductive first sealing portion 60, a resistor 70, a conductive second sealing portion 80, a first packing 8, a talc 9, a second packing 6, and a third packing 7.

The insulator 10 is a substantially cylindrical member that extends along the axial line CL and has an axial hole 12 which is a through hole penetrating through the insulator 10. The insulator 10 is formed by sintering alumina (another insulating material may be used). The insulator 10 has a leg portion 13, a first reduced outer diameter portion 15, a first trunk portion 17, a flange portion 19, a second reduced outer diameter portion 11, and a second trunk portion 18 that are disposed in sequence toward the rear end direction BD. The outer diameter of the first reduced outer diameter portion 15 gradually reduces toward the front end direction LD. In the vicinity of the first reduced outer diameter portion 15 of the insulator 10 (the first trunk portion 17 in the example of FIG. 1), a reduced inner diameter portion 16 having an inner diameter that gradually reduces toward the front end direction LD is formed. The outer diameter of the second reduced outer diameter portion 11 gradually reduces toward the rear end direction BD.

At the front side of the axial hole 12 of the insulator 10, the rod-shaped center electrode 20 extending along the axial line CL is inserted. The center electrode 20 has a leg portion 25, a flange portion 24, and a head portion 23 that are disposed in sequence from the front side toward the rear end direction BD. A part, at the front side, of the leg portion 25 is exposed outside the axial hole 12 at the front side of the insulator 10. The remaining part of the center electrode 20 is disposed inside the axial hole 12. The surface, at the front side, of the flange portion 24 is supported by the reduced inner diameter portion 16 of the insulator 10. The center electrode 20 has an electrode base material 21, and a core material 22 embedded in the electrode base material 21. The electrode base material 21 is formed by using, for example, nickel (Ni) or an alloy containing nickel as a main component (e.g., NCF600, NCF601). Here, the "main component" means a component having a highest content (the same applies hereinafter). The core material 22 is formed from a material having a higher coefficient of thermal conductivity than that of the electrode base material 21 (for example, an alloy containing copper).

At the rear side of the axial hole 12 of the insulator 10, the metal terminal 40 is inserted. The metal terminal 40 is formed by using a conductive material (for example, metal such as low-carbon steel). The metal terminal 40 has a cap mounting portion 41, a flange portion 42, and a leg portion 43 that are disposed in sequence toward the front end direction LD. The cap mounting portion 41 is exposed outside the axial hole 12 at the rear side of the insulator 10. The leg portion 43 is inserted in the axial hole 12 of the insulator 10.

In the axial hole 12 of the insulator 10, the cylindrical resistor 70 is disposed between the metal terminal 40 and the center electrode 20 so as to suppress electric noises. Between the resistor 70 and the center electrode 20, the conductive first sealing portion 60 is disposed, and between the resistor 70 and the metal terminal 40, the conductive second sealing portion 80 is disposed. The center electrode 20 and the metal terminal 40 are electrically connected with each other with the resistor 70 and the sealing portions 60 and 80 interposed therebetween. By using the sealing portions 60 and 80, the contact resistance between the members 20, 60, 70, 80, and 40 that are stacked is stabilized, and the electric resistance between the center electrode 20 and the metal terminal 40 can be stabilized. The resistor 70 is formed, for example, by using glass particles (e.g., $B_2O_3$—$SiO_2$ glass) which form a main component, ceramic particles (e.g., $TiO_2$), and a conductive material (e.g., Mg). The sealing portions 60 and 80 are formed by using, for example, glass particles that are similar to those used for the resistor 70, and metal particles (e.g., Cu).

The metal shell 50 is a substantially cylindrical member that extends along the axial line CL and has an insertion hole 59 penetrating through the metal shell 50. The metal shell 50 is formed by using a low-carbon steel material (other conductive materials (for example, metallic materials) may be used). In the insertion hole 59 of the metal shell 50, the insulator 10 is inserted. The metal shell 50 is fixed to the insulator 10 in such a manner as to surround the radial circumference of the insulator 10. At the front side of the metal shell 50, an end portion at the front side of the insulator 10 (the portion at the front side of the leg portion 13 in the present embodiment) is exposed outside the insertion hole 59. At the rear side of the metal shell 50, an end portion at the rear side of the insulator 10 (the portion at the rear side of the second trunk portion 18 in the present embodiment) is exposed outside the insertion hole 59.

The metal shell 50 has a trunk portion 55, a seat portion 54, a deformation portion 58, a tool engagement portion 51, and a crimp portion 53 that are disposed in sequence toward the rear end direction BD. The seat portion 54 is a flange-shaped portion. On the inner peripheral surface of the trunk portion 55, a screw portion 52 which is to be screwed into a mounting hole of an internal combustion engine (for example, gasoline engine) is formed. Between the seat portion 54 and the screw portion 52, a circular gasket 5 formed by bending a metallic plate is fitted in.

The metal shell 50 has a reduced inner diameter portion 56 disposed at the front side with respect to the deformation portion 58. The reduced inner diameter portion 56 has an inner diameter that gradually reduces toward the front end direction LD. Between the reduced inner diameter portion 56 of the metal shell 50 and the first reduced outer diameter portion 15 of the insulator 10, the first packing 8 is sandwiched. The first packing 8 is an O ring made of iron (other materials (for example, metallic materials such as copper) may be used).

The tool engagement portion 51 is formed in a shape (for example, hexagonal column) that allows the tool engagement portion 51 to be engaged with an ignition plug wrench. At the rear side of the tool engagement portion 51, a crimp portion 53 is provided. The crimp portion 53 is disposed at the rear side with respect to the second reduced outer diameter portion 11 of the insulator 10, and forms an end, at the rear side, of the metal shell 50. The crimp portion 53 is bent inwardly in the radial direction.

At the rear side of the metal shell 50, a circular space SP is formed between the inner peripheral surface of the metal shell 50, and the inner peripheral surface of the insulator 10. In this embodiment, the space SP is surrounded by the crimp portion 53 and the tool engagement portion 51 of the metal shell 50, and the second reduced outer diameter portion 11 and the second trunk portion 18 of the insulator 10. At the rear side in the space SP, the second packing 6 is disposed. At the front side in the space SP, the third packing 7 is disposed. In the present embodiment, each of these packings 6 and 7 is a C ring made of iron (another material may be used). Between the two packings 6 and 7 in the space SP, powder of the talc 9 is filled.

When the ignition plug 100 is manufactured, the crimp portion 53 is crimped so as to be bent inwardly. Then, the crimp portion 53 is pressed toward the front side. Accordingly, the deformation portion 58 deforms, and the insulator 10 is pressed toward the front side in the metal shell 50 via the packings 6 and 7 and the talc 9. The first packing 8 is pressed between the first reduced outer diameter portion 15 and the reduced inner diameter portion 56, to seal a portion between the metal shell 50 and the insulator 10. Thus, the gas in the combustion chamber of the internal combustion engine is prevented from leaking outside through between the metal shell 50 and the insulator 10. Also, the metal shell 50 is fixed to the insulator 10.

The ground electrode 30 is bonded to the end, at the front side, of the metal shell 50. The ground electrode 30 has a ground electrode base material 33, a ground electrode tip 38, and a fixing member 39. In the present embodiment, the ground electrode base material 33 is a rod-shaped member. One end of the ground electrode base material 33 is a connection end 332 that is electrically connected to the end, at the front side, of the metal shell 50, for example, by resistance welding. The other end of the ground electrode base material 33 is a free end 333. The ground electrode base material 33 extends from the connection end 332 connected to the metal shell 50 toward the front end direction LD, and bends toward the axial line CL. The ground electrode base material 33 extends to the free end 333 in the direction perpendicular to the axial line CL.

In the ground electrode base material 33, a part extending in the direction perpendicular to the axial line CL is also referred to as a front end portion 331. To the front end portion 331, the ground electrode tip 38 and the fixing member 39 are fixed. The ground electrode tip 38 defines a gap g with a discharge surface 20*s*1 (surface at the front side) of the center electrode 20. The ground electrode base material 33 is formed by using, for example, Ni or an alloy containing Ni as a main component (e.g., NCF600, NCF601). The ground electrode base material 33 may have a bilayer structure containing a surface portion that forms the surface, and a core portion embedded in the surface portion. In this case, the surface portion is formed by using, for example, Ni or an alloy containing Ni as a main component, and the core portion is formed by using a material (for example, pure copper) having a coefficient of thermal conductivity higher than the surface portion.

Figure 2:
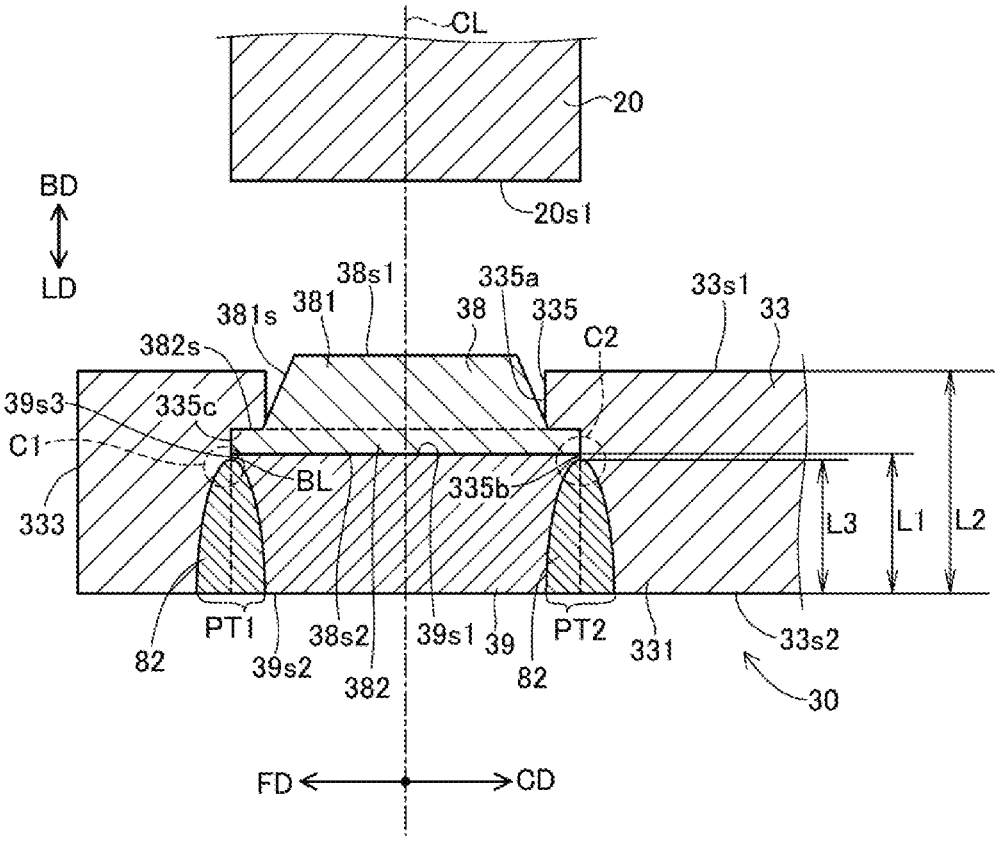
FIG. 2 is a partial cross-sectional view showing, in an enlarged manner, the vicinity of a front end portion of a ground electrode of the first embodiment.
Figure 3:
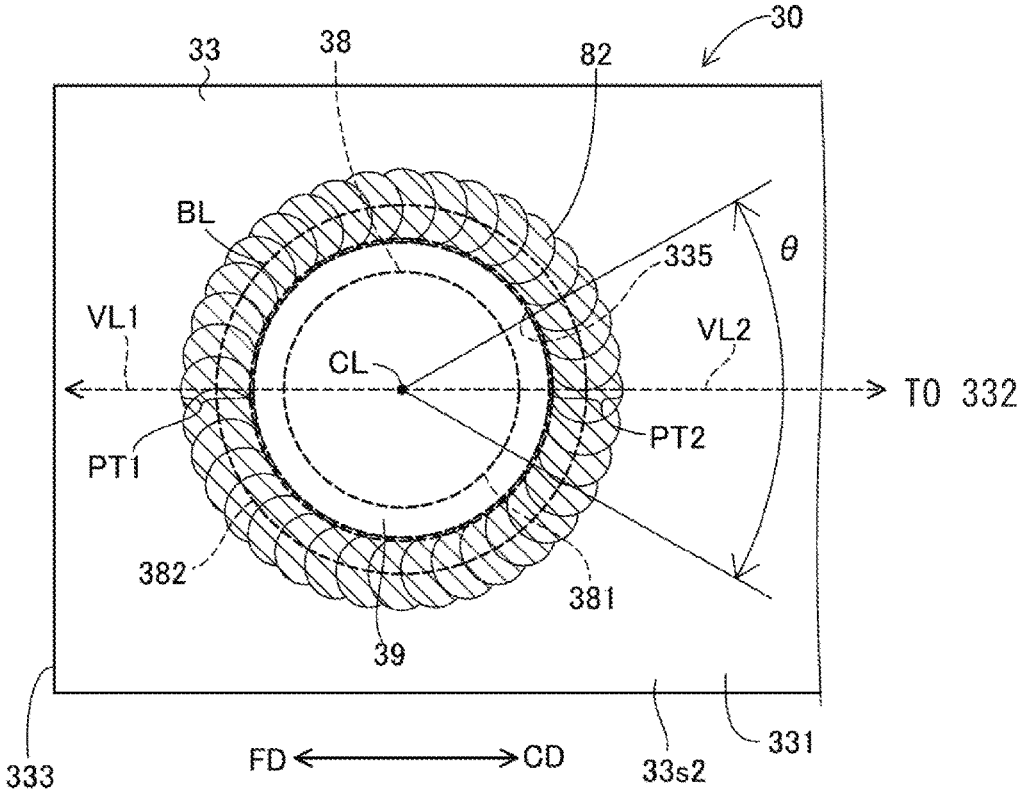
FIG. 3 is a schematic view of the vicinity of the front end portion of the ground electrode as viewed from the front side toward a rear end direction.
Figure 4:
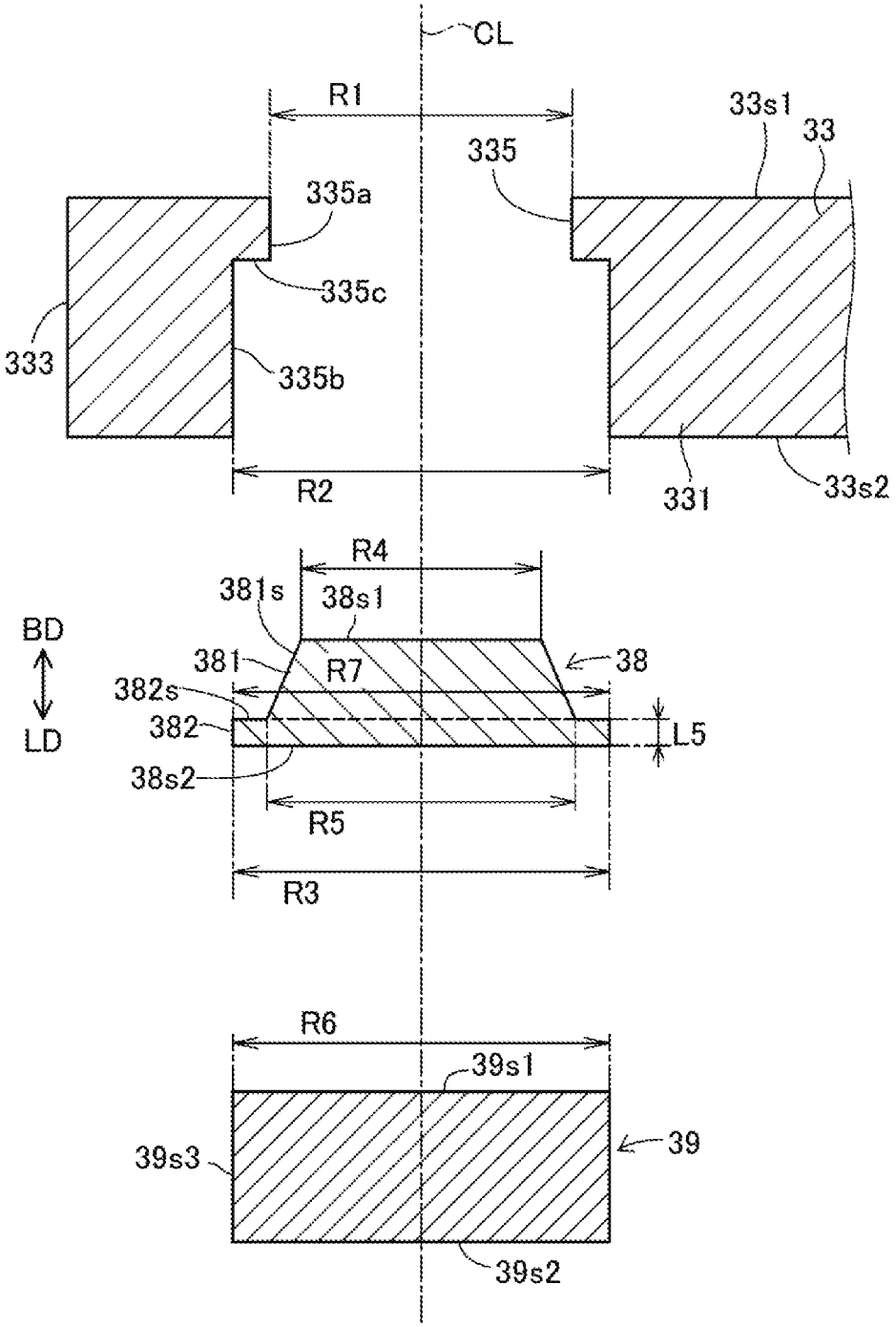
FIG. 4 is a cross-sectional view of the front end portion of the ground electrode before laser welding.

FIG. 2 is a partial cross-sectional view showing, in an enlarged manner, the vicinity of the front end portion 331 of the ground electrode 30 of the first embodiment. This cross section is a cross section that passes through the axial line CL of the fixing member 39 and that extends along the axial direction. FIG. 3 is a schematic view of the vicinity of the front end portion 331 of the ground electrode 30 as viewed from the front side toward the rear end direction BD. FIG. 4 is a cross-sectional view of the front end portion 331 of the ground electrode 30 before laser welding in the first embodiment. As shown in FIG. 2, the front end portion 331 extends in the direction perpendicular to the axial line CL. Here, the direction that is perpendicular to the axial line CL and is oriented from the axial line CL to the free end 333 is referred to as a free end direction FD. The direction that is perpendicular to the axial line CL and is opposite to the free end direction FD, namely the direction being oriented from the axial line CL to the connection end 332 is referred to as a connection end direction CD.

As shown in FIGS. 2 and 4, the front end portion 331 of the ground electrode base material 33 has a first surface 33*s*1 located at the rear side, namely, the first surface 33*s*1 facing the center electrode 20, and a second surface 33*s*2 which is a reverse face of the first surface 33*s*1, namely, the second surface 33*s*2 located at the front side. At a position of the front end portion 331 opposed to the discharge surface 20*s*1 of the center electrode 20, a through hole 335 penetrating from the first surface 33*s*1 to the second surface 33*s*2 is formed. As shown in FIG. 4, the through hole 335 has a small diameter portion 335*a* having a first diameter R1, and a large diameter portion 335*b* located at the front side with respect to the small diameter portion 335*a* and having a second diameter R2 that is larger than the first diameter R1. The ground electrode base material 33 has a step portion 335*c* located between the small diameter portion 335*a* and the large diameter portion 335*b* in the through hole 335. Thus, in the through hole 335, the second diameter R2 (FIG. 4) in the second surface 33*s*2 is larger than the first diameter R1 (FIG. 4) in the first surface 33*s*1.

As shown in FIGS. 2 and 4, the ground electrode tip 38 has a discharge surface 38*s*1 at the rear side, and a large diameter surface 38*s*2 which is a reverse face of the discharge surface 38*s*1 (namely, the surface at the front side). The direction oriented from the large diameter surface 38*s*2 to the discharge surface 20*s*1 (rear end direction BD in the present embodiment) is referred to as a first direction, and the opposite direction thereof (front end direction LD in the present embodiment) is referred to as a second direction.

The discharge surface 38*s*1 is a surface that defines the gap g, together with the discharge surface 20*s*1 of the center electrode 20. The ground electrode tip 38 has a tip body 381 including the discharge surface 38*s*1, and a flange portion 382 including the large diameter surface 38*s*2 and located at the front side with respect to the tip body 381. The diameter of the tip body 381 linearly reduces toward the center electrode 20, namely, from a diameter R5 to a diameter R4 from the front side to the rear side. In other words, the tip body 381 has a truncated conical shape having a tapered outer surface 381*s*. The diameter of the flange portion 382 is larger than the diameter R5 at the front end and the diameter R4 at the rear end of the tip body 381. The axial line CL of the electrode tip is the same as the axial line CL of the ignition plug 100. As can be recognized from this explanation, the diameter R3 (FIG. 4) of the large diameter surface 38*s*2 is larger than the diameter R4 of the discharge surface 38*s*1 (the diameter R4 at the rear end of the tip body 381). The diameter R4 of the discharge surface 38*s*1 is smaller than the first diameter R1 in the first surface 33*s*1 of the through hole 335 (the diameter of the small diameter portion 335*a*). The diameter R3 of the large diameter surface 38*s*2 is larger than the first diameter R1 in the first surface 33*s*1 of the through hole 335, and is slightly smaller than the second diameter R2 in the second surface 33*s*2 (the diameter R2 of the large diameter portion 335*b*).

Here the diameter of the rear end of the flange portion 382 (the diameter at the side of the discharge surface 38*s*1) is referred to as R7. In the present embodiment, since the flange portion 382 has a cylindrical shape in which the diameter does not vary depending on the position along the axial direction, the diameter R7 of the rear end of the flange portion 382 is equal to the diameter R3 at the front end of the flange portion 382 (the diameter R3 of the large diameter surface 38*s*2). The percentage of the diameter R5 at the front end of the tip body 381 relative to the diameter R7 of the flange portion 382 is not less than 76% and not more than 96%. In examples of FIGS. 2 and 4, the percentage of the diameter R5 at the front end of the tip body 381 relative to the diameter R7 is approximately 80%. The diameter R5 at the front end of the tip body 381 is substantially equal to the diameter R1 of the small diameter portion 335*a* of the through hole 335.

The ground electrode tip 38 is formed by using an alloy containing noble metal having excellent spark wear property as a main component. In the present embodiment, the noble metal that is to be a main component is iridium (Ir). Ir has a high melting point among other noble metals, and has excellent spark wear resistance. Therefore, it is preferred to form the ground electrode tip 38 by using Ir, or an iridium alloy containing Ir as a main component.

As shown in FIG. 2, a part of the ground electrode tip 38, including the large diameter surface 38*s*2 is disposed in the through hole 335, and the discharge surface 38*s*1 is exposed to the center electrode 20 side from the through hole 335. To be more specific, the whole of the flange portion 382 of the ground electrode tip 38 is located at the rear side in the large diameter portion 335*b* of the through hole 335, and a majority part at the front side of the tip body 381 is located in the small diameter portion 335*a* of the through hole 335. A part at the rear side of the tip body 381 including the discharge surface 38*s*1 projects to the rear side from the through hole 335. A rear end face 382*s* of the flange portion 382 abuts on the step portion 335*c* in the through hole 335, and is supported, from the rear side, by the step portion 335*c*.

As shown in FIGS. 2 and 4, the fixing member 39 has a substantially cylindrical profile. The axial line CL of the ground electrode tip 38, the through hole 335, and the fixing member 39 is the same as the axial line CL of the ignition plug 100. The fixing member 39 is disposed in the portion at the front side with respect to the large diameter surface 38*s*2 of the ground electrode tip 38 in the large diameter portion 335*b* of the through hole 335. A rear end face 39*s*1 of the fixing member 39 abuts on the large diameter surface 38*s*2 of the ground electrode tip 38. That is, the fixing member 39 supports the ground electrode tip 38 (the flange portion 382) from the front side. A front end face 39*s*2 of the fixing member 39 is located substantially flush with the second surface 33*s*2 of the ground electrode base material 33. The diameter R6 of the fixing member 39 before laser welding is substantially the same as the diameter R2 of the large diameter portion 335*b* of the through hole 335.

As can be recognized from the foregoing explanation, the ground electrode tip 38 is held by the inner surface of the ground electrode base material 33 that forms the through hole 335, and the surface at the rear side of the fixing member 39.

As shown in FIG. 2, a maximum length L1 along the axial direction of a part of the fixing member 39, the part being disposed in the through hole 335, is not less than 50% of a maximum length L2 along the axial direction of the part (namely, the front end portion 331) where the through hole 335 is formed in the ground electrode base material 33. In the example of FIG. 2, the maximum length L1 is approximately 60% of the maximum length L2. The maximum length L1 is more preferably not less than 60%, further preferably not less than 70% of the maximum length L2. The higher the percentage of the maximum length L1 relative to the maximum length L2 is, the more the bonding strength of the fixing member 39 can be improved. The maximum length L1 is necessarily less than 100% of the maximum length L2, and is less than 90% of the maximum length L2 when the thickness of the ground electrode tip 38 is taken into consideration.

In the example of FIG. 2, since almost the whole of the fixing member 39 is disposed in the through hole 335, the maximum length L1 is substantially equal to the length, along the axial direction, of the fixing member 39. Assuming that a part of the fixing member 39 projects to the front side with respect to the second surface 33*s*2, the maximum length, along the axial direction, of a part of the fixing member 39 excluding the projecting part is defined as the maximum length L1. The maximum length L1 can be said as the maximum length (distance), along the axial direction, from the rear end of the fixing member 39 to the second surface 33*s*2 of the front end portion 331 of the ground electrode base material 33.

The maximum length L2 along the axial direction of the part (namely, front end portion 331) where the through hole 335 is formed in the ground electrode base material 33 can be said as the maximum length (distance), along the axial direction, from the first surface 33*s*1 to the second surface 33*s*2 of the front end portion 331.

As shown in FIG. 3, at a boundary BL between an outer surface 39*s*3 of the fixing member 39 and the inner surface of the ground electrode base material 33 that forms the large diameter portion 335*b* of the through hole 335, a melt portion 82 is formed over the entire circumference. In FIG. 3, the hatched part indicates a part of the melt portion 82 that is exposed to the second surface 33*s*2 of the ground electrode base material 33. The melt portion 82 is formed by irradiating the second surface 33*s*2 of the ground electrode base material 33 with a laser beam vertically.

As shown in FIG. 2, the melt portion 82 is formed so as to extend over the boundary BL between the outer surface 39*s*3 of the fixing member 39, and the inner surface of the ground electrode base material 33 forming the large diameter portion 335*b* of the through hole 335 in the cross section of FIG. 2.

The melt portion 82 is a part that includes the component of the ground electrode base material 33 and the component of the fixing member 39 that are mutually melted. The ground electrode base material 33, and the fixing member 39 are bonded to each other via the melt portion 82. Therefore, the melt portion 82 can be said as a bonding portion that bonds the ground electrode base material 33 and the fixing member 39, or can be said as a bead that bonds the ground electrode base material 33 and the fixing member 39.

Even when the ground electrode base material 33 and the fixing member 39 are made of the same material (e.g., NCF600), the melt portion 82 is different from the ground electrode base material 33 and the fixing member 39, for example, in terms of the microscopic structure such as the grain size because the melt portion 82 is formed by melting at high temperature. Accordingly, for example, by cutting the ground electrode 30 to expose the cross section of FIG. 2, and observing the cross section after conducting an etching treatment on the cross section, it is possible to clearly identify the boundary between the ground electrode base material 33, the fixing member 39, and the melt portion 82.

In the cross section of FIG. 2, a length (depth) L3 along the axial direction of the melt portion 82 is not less than 50% of the maximum length L1 along the axial direction of the part of the fixing member 39, the part being disposed in the through hole 335. Here, the length (depth) L3 along the axial direction of the melt portion 82 can be defined as a length, along the axial direction, from the rear end of the melt portion 82 to the second surface 33*s*2 of the front end portion 331 of the ground electrode base material 33 in the boundary BL between the ground electrode base material 33 and the fixing member 39.

As can be recognized from the parts surrounded by circles C1 and C2 of broken lines in FIG. 2, in the example of FIG. 2, the boundary BL between the ground electrode base material 33 and the fixing member 39 remains only slightly. The length L3 along the axial direction of the melt portion 82 is approximately 95% of the maximum length L1 of the fixing member 39. The length L3 is more preferably not less than 70%, further preferably not less than 80%, particularly preferably not less than 90% of the maximum length L1. The higher the percentage of the length L3 relative to the maximum length L1 is, the more the bonding strength of the fixing member 39 can be improved. In the first embodiment, as can be recognized from the parts surrounded by circles C1 and C2 of broken lines, the melt portion 82 does not reach the flange portion 382 of the ground electrode tip 38 over the entire circumference of the boundary BL between the fixing member 39 and the ground electrode base material 33. That is, the rear end of the melt portion 82 is located at the front side with respect to the large diameter surface 38*s*2 of the ground electrode tip 38 over the entire circumference. In other words, the percentage of the length L3 relative to the maximum length L1 is less than 100%.

According to the ignition plug 100 of the first embodiment as described above, the maximum length L1 along the axial direction of the part of the fixing member 39, the part being disposed in the through hole 335, is not less than 50% of the maximum length L2 along the axial direction of the part where the through hole 335 is formed in the ground electrode base material 33, and the length L3, along the axial direction, from the end at the rear side of the melt portion 82 to the second surface 33*s*2 of front end portion 331 of the ground electrode base material 33 in the boundary BL between the ground electrode base material 33 and the fixing member 39 is not less than 50% of the maximum length L1 along the axial direction of the part of the fixing member 39, the part being disposed in the through hole 335. Therefore, the length along the axial direction of the melt portion 82 can be sufficiently secured, and it is possible to improve the strength with which the fixing member 39 is fixed to the ground electrode base material 33. In particular, the front end of the ignition plug 100 where the fixing member 39 is located is closest to the part where the temperature becomes high in the combustion chamber, and thus the temperature of the part becomes very high during use of the ignition plug 100. Accordingly, the melt portion 82 and the fixing member 39 are susceptible to damage. In the ignition plug 100 of the first embodiment, the length along the axial direction of the melt portion 82 is secured sufficiently, and thus the strength, particularly in the high temperature environment can be improved.

Further, the rear end face 382*s* of the flange portion 382 of the ground electrode tip 38 is supported by the step portion 335*c* in the through hole 335. Therefore, the rear end face 382*s* of the flange portion 382 and the step portion 335*c* come into surface contact with each other, and thus it is possible to improve the strength with which the ground electrode tip 38 is fixed to the ground electrode base material 33. Also, fluctuation of the gap, during use of the ignition plug 100, formed between the discharge surface 38*s*1 of the ground electrode tip 38 and the discharge surface 20*s*1 of the center electrode 20 can be suppressed.

Further, the percentage of the diameter R5 at the front end of the tip body 381 relative to the diameter R7 of the flange portion 382 (R5/R7) is not less than 76% and not more than 95%. Therefore, it is possible to improve the wear resistance of the ignition plug 100, and it is possible to further improve the strength with which the ground electrode tip 38 is fixed to the ground electrode base material 33. Specifically, since the percentage (R5/R7) of not less than 76% can prevent the diameter R4 of the discharge surface 38*s*1 from becoming excessively small and secure the diameter R4 of the discharge surface 38*s*1, it is possible to improve the wear resistance of the ignition plug 100. Since the percentage (R5/R7) of not more than 95% can secure the width in the radial direction of the flange portion 382 (width of the rear end face 382*s* of the flange portion 382), it is possible to further improve the strength with which the ground electrode tip 38 is fixed to the ground electrode base material 33.

Further, in the ignition plug 100 of the first embodiment, the ground electrode tip 38 is formed of any of iridium and an iridium alloy. Accordingly, in the ignition plug 100 which is formed by using iridium or an iridium alloy and which is used in a high temperature environment, it is possible to further improve the strength with which the ground electrode tip 38 is fixed to the ground electrode base material 33.

Figure 5:
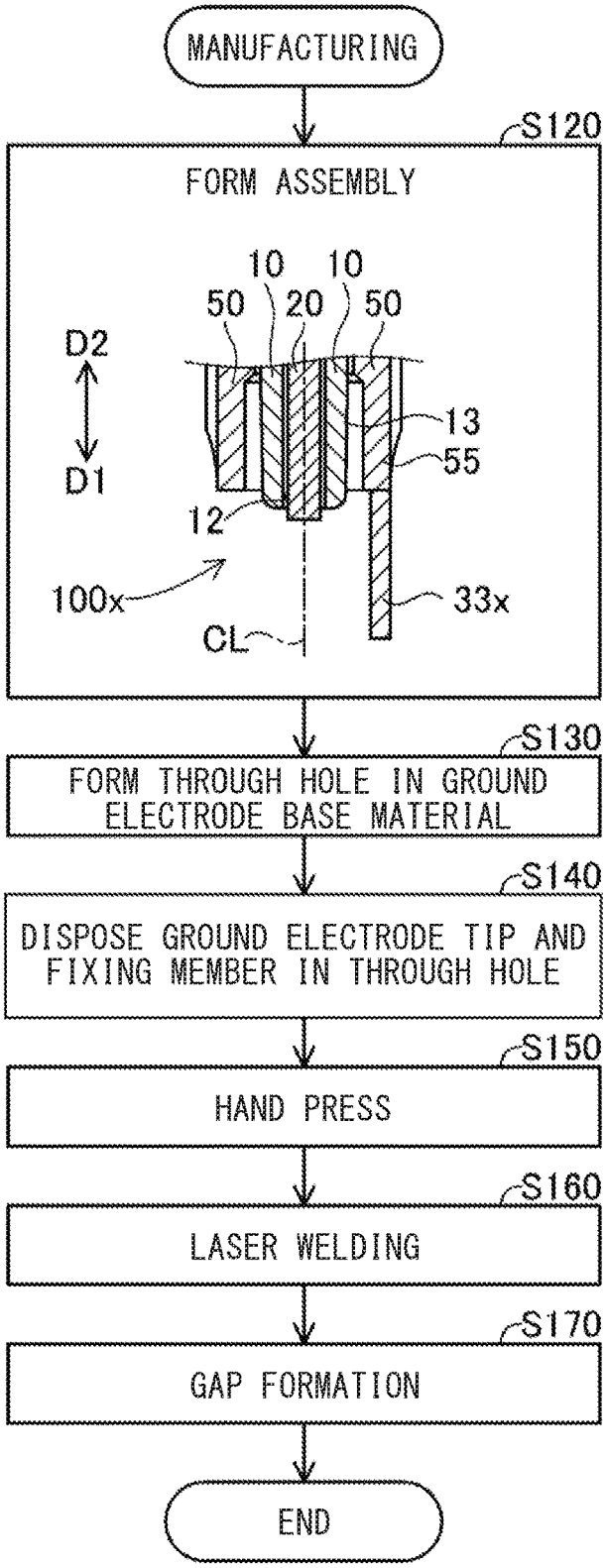
FIG. 5 is a flow chart showing one example of a method of manufacturing an ignition plug.

A-2. Manufacturing Method of Ignition Plug:

FIG. 5 is a flow chart showing one example of a method of manufacturing an ignition plug. FIG. 6 is an explanatory view showing a method of manufacturing the ground electrode 30. In step S120, an assembly is formed. The assembly is in a state, in the manufacturing process of the ignition plug 100 shown in FIG. 1, in which bending of the ground electrode base material 33 of the ground electrode 30, and mounting of the ground electrode tip 38 and the fixing member 39 onto the ground electrode base material 33 are not yet performed. The box indicating step S120 in FIG. 5 shows a partial cross-sectional view showing the vicinity of the center electrode 20 of an assembly 100*x*. The assembly 100*x* has the insulator 10, the metal shell 50 fixed to the insulator 10, and the center electrode 20 inserted into the axial hole 12 of the insulator 10. To the metal shell 50, a ground electrode base material 33*x* in a linear shape is bonded as the ground electrode base material 33 before being subjected to bending. As a method for forming the assembly 100*x*, various known methods can be adopted, and the detailed description will be omitted.

In step S130, the through hole 335 is formed in the ground electrode base material 33*x* of the ground electrode 30. The shape of the through hole 335 is as described above by referring to FIG. 4. The through hole 335 is formed in the ground electrode base material 33*x* before being subjected to bending, for example, by using a cutting tool such as a drill.

Figure 6A:
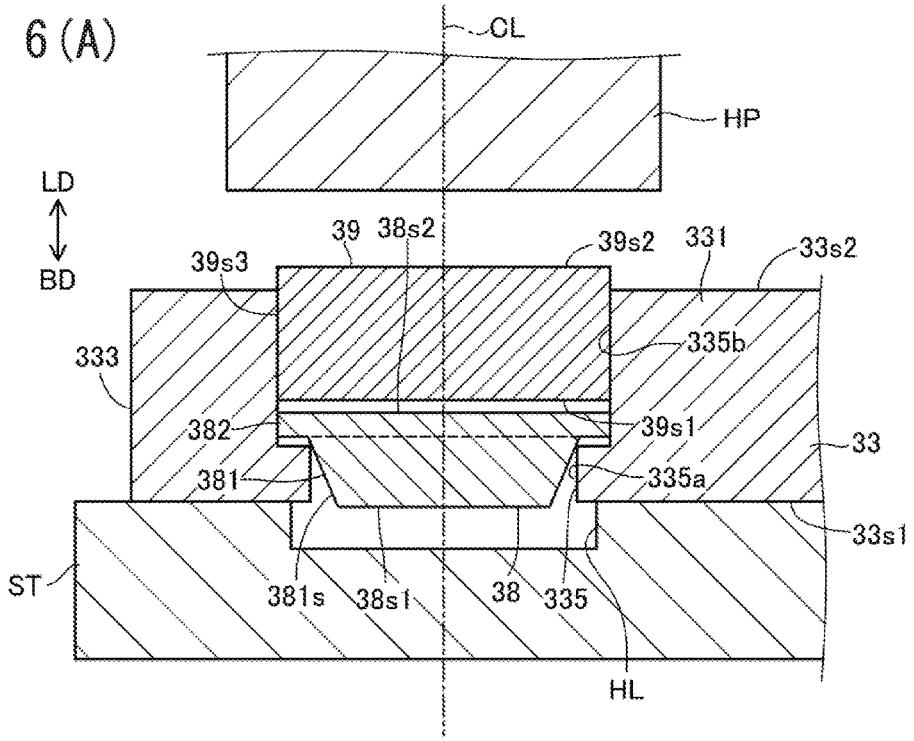
FIGS. 6(A) and 6(B) are explanatory views showing a method of manufacturing a ground electrode 30.
Figure 6B:
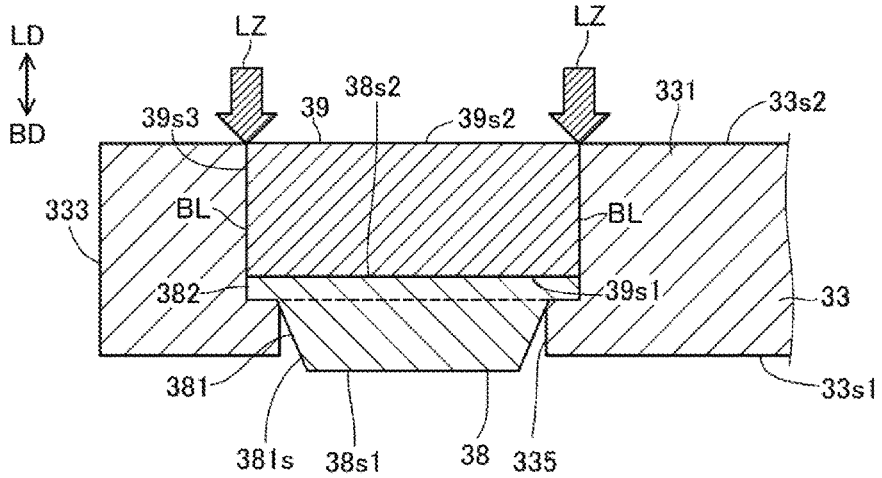

In step S140, as shown in FIG. 6(A), in the formed through hole 335, the ground electrode tip 38 and the fixing member 39 are disposed in this sequence from the front side of the through hole 335 (upper side in FIG. 6(A)). At this time, since the tip body 381 of the ground electrode tip 38 projects to the rear side (lower side in FIG. 6(A)) with respect to the through hole 335, the ground electrode tip 38 and the fixing member 39 are disposed while the ground electrode base material 33*x* is disposed on a support ST having a recess portion HL formed therein.

In step S150, the front end face 39*s*2 of the fixing member 39 is pressed toward the rear end direction BD by a hand press HP. Therefore, the fixing member 39 is pushed-in in the rear end direction BD to the position where the flange portion 382 is sandwiched between the rear end face 39*s*1 of the fixing member 39 and the step portion 335*c* in the through hole 335. While the fixing member 39 is pushed-in to this position, the length along the axial direction of the fixing member 39 is determined so that the front end face 39*s*2 of the fixing member 39 slightly (for example, 0.1 mm) projects to the front side with respect to the second surface of the front end portion 331 of the ground electrode base material 33. Thus, it is possible to push the fixing member 39 into a predetermined position with high accuracy by means of the hand press HP.

In step S160, the fixing member 39 and the ground electrode base material 33 are bonded by laser welding. An arrow head LZ in FIG. 6(B) conceptually shows the laser irradiation for laser welding. The laser beam LZ is emitted on the boundary BL between the inner surface of the through hole 335 and the outer surface 39*s*3 of the fixing member 39 perpendicularly to the second surface 33*s*2 of the ground electrode base material 33. Irradiation with the laser beam LZ is conducted over the entire circumference of the boundary BL between the ground electrode base material 33 and the fixing member 39, as shown in FIG. 3. For example, by irradiating twenty-four positions with the laser beam LZ at a speed of 12 Hz, the melt portion 82 is formed over the entire circumference of the boundary BL. As a result, the melt portion 82 shown in FIGS. 2 and 3 is formed.

In step S170, the ground electrode base material 33*x* is bent and the gap g is formed. Specifically, as shown in FIG. 2, the ground electrode base material 33*x* is bent toward the center electrode 20 so that the discharge surface 20*s*1 of center electrode 20 and the discharge surface 38*s*1 of the ground electrode tip 38 are opposed to each other.

A-3. Evaluation Test:

A-3-1. First Evaluation Test

An evaluation test was conducted by using a sample of the ignition plug 100. In the first evaluation test, as shown in Table 1, six types of ignition plug samples 1 to 6 were prepared. In these samples, the ground electrode tip 38 was not mounted, and only the fixing member 39 was welded to the ground electrode base material 33. The dimensions that are common among these samples are as follows.

Length L5 in the axial direction of the flange portion 382: 0.2 mm

Outer diameter R6 of the fixing member 39: 3.3 mm

Length L2 between the first surface 33*s*1 and the second surface 33*s*2 of the ground electrode base material 33: 1.5 mm Material of the fixing member 39: NCF600

Material of the ground electrode base material 33: NCF600

TABLE 1

| Number | 1 | 2 | 3 | 4 | 5 | 6 |
|---|---|---|---|---|---|---|
| L1 (mm) | 1.2 | 1.1 | 1 | 0.9 | 0.75 | 0.6 |
| L1/L2 (%) | 80 | 73.3 | 66.7 | 60 | 50 | 40 |
| High temperature strength | A | A | A | A | A | B |

In six types of samples 1 to 6, the length along the axial direction of the fixing member 39, and the length along the axial direction of the large diameter portion 335*b* of the through hole 335 were set to be 1.2 mm, 1.1 mm, 1 mm, 0.9 mm, 0.75 mm, and 0.6 mm, respectively. Therefore, in the six types of samples 1 to 6, as shown in Table 1, the maximum length L1 along the axial direction of the part of the fixing member 39, the part being disposed in the through hole 335, was set to be 1.2 mm, 1.1 mm, 1 mm, 0.9 mm, 0.75 mm, and 0.6 mm, respectively. The length L3 along the axial direction of the melt portion 82 was adjusted to 50% of the length L1.

In the six types of samples 1 to 6, the percentage of the length L1 relative to the length L2 (L1/L2) was adjusted to 80%, 73.3%, 66.7%, 60%, 50%, and 40%, respectively by adjusting the maximum length L1 as described above.

For samples 1 to 6, a high temperature strength test was conducted. In the high temperature strength test, the vicinity of the fixing member 39 of each sample was heated to 1050° C. by using a high-frequency heater. Then, the rear end face 39*s*1 of the fixing member 39 having been heated was subjected to a load of 1000 N applied in the front end direction LD by using a metal bar.

Thereafter, each sample was observed from the second surface 33*s*2 side of the ground electrode base material 33, and occurrence of a breakage in the melt portion 82 was checked. The sample in which a breakage occurred in the melt portion 82 was evaluated as "B", and the sample in which a breakage did not occur in the melt portion 82 was evaluated as "A".

The result of the evaluation is shown in Table 1. The sample in which the percentage of the length L1 relative to the length L2 (L1/L2) is less than 50%, that is, sample 6 having a (L1/L2) of 40% was evaluated as "B". The samples in which (L1/L2) is not less than 50%, that is, samples 1 to 5 having a (L1/L2) of 50%, 60%, 66.7%, 73.3%, and 80%, respectively were evaluated as "A". By setting the (L1/L2) to be not less than 50%, it is possible to increase the length in the axial direction of the boundary BL between the fixing member 39 and the ground electrode base material 33, and thus, it is possible to increase the length in the axial direction of the melt portion 82. It is conceivable that this improves the strength with which the fixing member 39 is bonded to the ground electrode base material 33.

A-3-2. Second Evaluation Test

In the second evaluation test, five types of ignition plug samples 7 to 11 were prepared by varying the length L3 along the axial direction of the melt portion 82 with regard to sample 4 used the first evaluation test (L1=0.9 mm), as shown in Table 2.

TABLE 2

| Number | 7 | 8 | 9 | 10 | 11 |
|---|---|---|---|---|---|
| L3 (mm) | 0.3 | 0.45 | 0.6 | 0.75 | 0.9 |
| L3/L1 (%) | 33.3 | 50 | 66.7 | 83.3 | 100 |
| Bending strength | B | A | A | A | A |

As shown in Table 2, in the five types of samples 7 to 11, the length L3 along the axial direction of the melt portion 82 was set to be 0.3 mm, 0.45 mm, 0.6 mm, 0.75 mm, and 0.9 mm, respectively. Therefore, in the five types of samples 7 to 11, the percentage of the length L3 relative to the length L1 (L3/L1) was adjusted to 33.3%, 50%, 66.7%, 83.3%, and 100%, respectively. The structure of other part of these samples is the same as that of sample 4 in the first evaluation test.

Samples 7 to 11 were subjected to a bending test of bending the ground electrode base material 33 so that the second surface 33*s*2 of the front end portion 331 of the ground electrode base material 33 is bent convexly with a curvature R=2.0 mm. This bending test was conducted at normal temperature.

Thereafter, each sample was observed from the second surface 33*s*2 side of the ground electrode base material 33, and occurrence of a breakage in the melt portion 82 was checked. The sample in which a breakage occurred in the melt portion 82 was evaluated as "B", and the sample in which a breakage did not occur in the melt portion 82 was evaluated as "A".

The result of the evaluation is shown in Table 2. The sample in which the percentage of the length L3 relative to the length L1 (L3/L1) is less than 50%, that is, sample 7 having a (L3/L1) of 33.3% was evaluated as "B". The samples in which (L3/L1) is not less than 50%, that is, samples 8 to 11 having a (L3/L1) of 50%, 66.7%, 83.3%, and 100%, respectively were evaluated as "A". By setting the (L3/L1) to be not less than 50%, it is possible to increase the length in the axial direction of the melt portion 82. It is conceivable that this improves the strength with which the fixing member 39 is bonded to the ground electrode base material 33.

According to the first evaluation test and the second evaluation test, it was confirmed that, from the view point of improvement in strength, preferably, the maximum length L1 along the axial direction of the part of the fixing member 39, the part being disposed in the through hole 335, is not less than 50% of the maximum length L2 along the axial direction of the front end portion 331 of the ground electrode base material 33, and the length L3, along the axial direction, from the rear end of the melt portion 82 to the second surface 33*s*2 of the ground electrode base material 33 in the boundary between the ground electrode base material 33 and the fixing member 39 is not less than 50% of the maximum length L1 along the axial direction of the part of the fixing member 39, part being disposed in the through hole 335.

A-3-3. Third Evaluation Test

In the third evaluation test, seven types of samples 12 to 18 of the ground electrode tip 38 were prepared by setting the diameter R7 of the flange portion 382 to a common value of 3.3 mm, and setting the diameter R5 of the front end of the tip body 381 to be 2 mm, 2.3 mm, 2.5 mm, 2.7 mm, 2.9 mm, 3.15 mm, and 3.2 mm, respectively, as shown in Table 3. The length along the axial direction of the tip body 381 was set to a common value of 0.4 mm for every sample.

In the seven types of samples 12 to 18, by adjusting the diameter R5 of the front end of the tip body 381 as described above, the percentage of the diameter R5 of the front end of the tip body 381 relative to the diameter R7 of the flange portion 382 (R5/R7) is adjusted to 61%, 70%, 76%, 82%, 88%, 95%, and 97%, respectively.

TABLE 3

| Number | 12 | 13 | 14 | 15 | 16 | 17 | 18 |
|---|---|---|---|---|---|---|---|
| R5 (mm) | 2 | 2.3 | 2.5 | 2.7 | 2.9 | 3.15 | 3.2 |
| R5/R7 (%) | 61 | 70 | 76 | 82 | 88 | 95 | 97 |
| Strength | A | A | A | A | A | A | B |
| Wear resistance | B | B | A | A | A | A | A |

For each of these samples 12 to 18 of the ground electrode tip 38, a strength test and a wear resistance test were conducted.

In the strength test, the large diameter surface 38*s*2 of each sample of the ground electrode tip 38) was subjected to a load of 150 N applied in the rear end direction BD by using a metal bar while each sample (the ground electrode tip 38) was fitted into the through hole 335 which has a shape corresponding thereto and which is formed in the ground electrode base material 33.

As a result of application of the load, the sample in which a breakage occurred in the flange portion 382 was evaluated as "B", and the sample in which a breakage did not occur in the flange portion 382 was evaluated as "A".

The result of evaluation is shown in Table 3. The sample in which the percentage of the diameter R5 of the front end of the tip body 381 relative to the diameter R7 of the flange portion 382 (R5/R7) is more than 95%, that is, sample 18 having a (R5/R7) of 97% was evaluated as "B". The samples in which the (R5/R7) is not more than 95%, that is, samples 12 to 17 having a (R5/R7) of 61%, 70%, 76%, 82%, 88%, and 95%, respectively were evaluated as "A". By setting the (R5/R7) to be not more than 95%, it is possible to prevent the flange portion 382 from breaking and prevent the ground electrode tip 38 from falling off, and it is conceivable that this improves the strength with which the ground electrode tip 38 is fixed to the ground electrode base material 33.

In the wear resistance test, the ignition plug 100 was assembled by using each sample of the ground electrode tip 38. Then, in a chamber of a nitrogen gas atmosphere at an air pressure of 0.6 MPa, the test of igniting the ignition plug of each sample at a frequency of 60 times per one second was conducted for 500 hours. In each sample, the initial gap was 0.3 mm.

After the test, in each sample of the ground electrode tip 38, the sample in which the whole of the initial state of the discharge surface 38*s*1 did not remain due to wear was evaluated as "B", and the sample in which at least part of the initial state of the discharge surface 38*s*1 remained without being worn was evaluated as "A".

The evaluation result is shown in Table 3. The samples in which the (R5/R7) is less than 76%, that is, samples 12 and 13 having a (R5/R7) of 61% and 70%, respectively were evaluated as "B". The samples in which the (R5/R7) is not less than 76%, that is, samples 14 to 18 having a (R5/R7) of 76%, 82%, 88%, 95%, and 97%, respectively were evaluated as "A". It is conceivable that by setting the (R5/R7) to be not more than 76%, the diameter of the discharge surface 38*s*1 is prevented from becoming excessively small, and the wear resistance is improved.

According to the third evaluation test, it was confirmed that, preferably, the percentage of the diameter R5 of the rear end of the tip body 381 relative to the diameter R7 of the flange portion 382 is not less than 76% and not more than 95% from the view point of improvement in strength and improvement in wear resistance.

B. Second Embodiment

Figure 7:
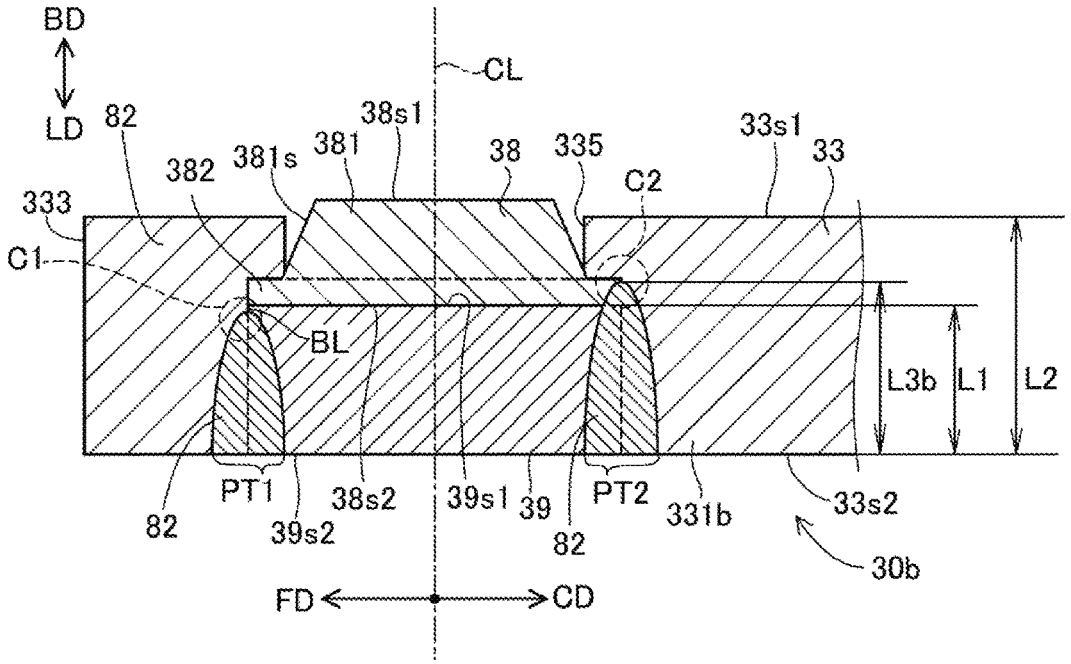
FIG. 7 is a partial cross-sectional view showing, in an enlarged manner, the vicinity of a front end portion of a ground electrode of an ignition plug of a second embodiment.

FIG. 7 is a partial cross-sectional view showing, in an enlarged manner, the vicinity of a front end portion 331*b* of a ground electrode 30*b* of an ignition plug of the second embodiment. Similarly to FIG. 2, the partial cross-sectional view of FIG. 7 is a cross section that passes through the axial line CL of fixing member 39 and that extends along the axial direction. In the first embodiment, the melt portion 82 does not reach the flange portion 382 of the ground electrode tip 38 over the entire circumference of the boundary BL between the fixing member 39 and the ground electrode base material 33. In the second embodiment, the melt portion 82 reaches the flange portion 382 of the ground electrode tip 38 in a part of the boundary BL between the fixing member 39 and the ground electrode base material 33, and does not reach the flange portion 382 of the ground electrode tip 38 in another part. The remaining parts of the structure of the second embodiment are the same as those of the first embodiment. The detailed description will be given below.

As shown in FIG. 3, in the second surface 33*s*2 of the ground electrode base material 33, a virtual line extending from the axial line CL toward the free end direction FD of the electrode tip 38 is referred to as a first line VL1, and a virtual line extending from the axial line CL toward the connection end direction CD of the electrode tip 38 is referred to as a second line VL2. At this time, in the second surface 33*s*2 of the ground electrode base material 33, a portion of the melt portion 82 hatched in FIG. 3 that intersects with the first line VL1 is referred to as a first portion PT1, and a portion of the melt portion 82 that intersects with the second line VL2 is referred to as a second portion PT2.

In the first embodiment, at any portion of the melt portion 82 including the first portion PT1 and the second portion PT2, the melt portion 82 does not reach the flange portion 382 of the ground electrode tip 38 (FIG. 2). In the second embodiment, as can be recognized from the part surrounded by the circle C1 of the broken line in FIG. 7, the melt portion 82 does not reach the flange portion 382 of the ground electrode tip 38, at the first portion PT1, as in the case in the first embodiment. Further, in the second embodiment, as can be recognized from the part surrounded by the circle C2 of the broken line in FIG. 7, the melt portion 82 reaches the flange portion 382 of the ground electrode tip 38, at the second portion PT2, differently from the first embodiment. In other words, in the second embodiment, the rear end of the melt portion 82 is located at the front side with respect to the large diameter surface 38*s*2 of the ground electrode tip 38, at the first portion PT1, and the rear end of the melt portion 82 is located at the rear side with respect to the large diameter surface 38*s*2 of the ground electrode tip 38, at the second portion PT2.

To be more specific, in FIG. 3, in a range of angle θ in the circumferential direction centered about the second portion PT2 of the melt portion 82, the melt portion 82 reaches the flange portion 382 of the electrode tip 38. Outside the range of angle θ in the circumferential direction, the melt portion 82 does not reach the flange portion 382 of the electrode tip 38. The angle θ indicating the range where the melt portion 82 reaches the electrode tip 38 is, for example, preferably more than 0 degrees and less than 160 degrees, and more preferably not less than 30 degrees and less than 120 degrees.

When the rear end of the melt portion 82 reaches the rear side, with respect to the rear end face 39*s*1, of the fixing member 39 as in the case of the melt portion 82 at the second portion PT2 of FIG. 7, the boundary BL between the fixing member 39 and the ground electrode base material 33 has completely melted and disappeared in that part. In such a part, it can be said that the length L3*b* along the axial direction of the melt portion 82 (FIG. 7) exceeds 100% of the maximum length L1 of the fixing member 39. That is, in the second embodiment, the percentage of the length L3*b* relative to the maximum length L1 (L3*b*/L1) exceeds 100%. For example, in the example of FIG. 7, the percentage of the length L3*b* relative to the maximum length L1 (L3*b*/L1) is more than 100% and less than 120%.

At the connection end 332 side of the ground electrode base material 33, the connection end 332 is connected to the metal shell 50, so that the heat transfer performance is good. According to the second embodiment, as described above, the melt portion 82 at a position intersecting with the first line VL1 extending in the connection end direction CD oriented from the center of the ground electrode tip 38 to the connection end 332 reaches the ground electrode tip 38. Therefore, the heat readily transfers from the ground electrode tip 38 that has been heated to a high temperature by a spark or a fuel gas ignited by the spark, to the connection end 332 side of the ground electrode base material 33 via the melt portion 82. For example, if the ground electrode tip 38 and the ground electrode base material 33 are not bonded at the connection end 332 side, the thermal conductivity decreases at the boundary surface between the ground electrode tip 38 and the ground electrode base material 33, and the heat becomes less likely to transfer from the ground electrode tip 38 to the connection end side of the ground electrode base material 33, in comparison with the second embodiment. Thus, according to the second embodiment, heat transfer performance of the ignition plug 100 is improved, and it is possible to prevent the ground electrode tip 38 from having excessively high temperature. Therefore, according to the second embodiment, it is possible to improve the wear resistance of the ground electrode tip 38, otherwise the wear resistance is impaired as the temperature of the ground electrode tip 38 increases.

Here, at the free end 333 side of the ground electrode base material 33, since the free end 333 is not connected to a metal shell, the heat transfer performance is poor and the temperature tends to become high. If a portion of the melt portion 82 that is near the free end 333 and tends to have high temperature, reaches the ground electrode tip 38, a crack is likely to occur in the melt portion 82 due to heat stress. Since the ground electrode tip 38 and the ground electrode base material 33 are made of different materials, and have different linear expansion coefficients, heat stress occurs in the bonding part in a high temperature environment. In the ignition plug of the second embodiment, the melt portion 82 at a position intersecting with the second line VL2 extending in the direction oriented from the center of the ground electrode tip 38 to the free end 333 does not reach the ground electrode tip 38. Accordingly, it is possible to prevent a crack from occurring in the melt portion 82 due to heat stress. Therefore, for example, it is possible to improve the durability of the ignition plug in a high temperature environment.

I. Modifications:

(1) In each of the above embodiments, the melt portion 82 is formed over the entire circumference of the boundary BL between the fixing member 39 and the ground electrode base material 33. Not limited to this, the melt portion 82 may be formed in some parts, not in the other parts, in the circumferential direction, of the boundary BL between the fixing member 39 and the ground electrode base material 33. For example, the melt portion 82 may be divided into a plurality of sections at intervals of a predetermined angle (for example, interval of 30 degrees or 60 degrees) along the circumferential direction of the boundary BL between the fixing member 39 and the ground electrode base material 33.

(2) The shape of the ground electrode tip 38 shown in each of the above embodiments is merely an example, and the shape is not limited to the example. For example, the flange portion 382 of the ground electrode tip 38 may be omitted, and the ground electrode tip 38 may be only the tip body 381 having a tapered shape (a truncated conical shape). In this case, for example, the diameter of the small diameter portion 335*a* of the through hole 335 can be reduced from the front side toward the rear end direction BD in accordance with the contour of the tip body 381.

When there is the flange portion 382, the tip body 381 may have a cylindrical shape rather than the tapered shape.

(3) The shape of the fixing member 39 shown in each of the above embodiments is merely an example, and the shape is not limited to the example. For example, the fixing member 39 may have a tapered shape that has a diameter reduced from the front side toward the rear end direction BD. In this case, the large diameter portion 335*b* of the through hole 335 may have a tapered shape in accordance with the shape of the fixing member 39. The melt portion 82 may be formed in such a manner that it extends diagonally with respect to the second surface 33*s*2 of the ground electrode base material 33 so as to correspond to the boundary between the fixing member 39 and the large diameter portion 335*b* having a tapered shape.

The shape of the fixing member 39 viewed from the rear side toward the front end direction LD may not be a circle, and may be another shape. For example, the shape of the fixing member 39 viewed from the rear side toward the front end direction LD may be an ellipse in which the length in the free end direction FD is longer than the length in the direction orthogonal to the free end direction FD.

While the fixing member 39 is formed by using NCF600 or NCF601, it may be formed by using other material having heat resistance, for example, a heat-resistant nickel alloy that is different from NCF600 or NCF601.

(4) In each of the above embodiments, the ground electrode tip 38 is formed of an iridium alloy, however, it may be formed of noble metal other than iridium, or an alloy containing the noble alloy as a main component. As the noble metal other than iridium, for example, platinum (Pt) or rhodium (Rh) may be used.

(5) As the structure of the ignition plug, various structure may be applied without limited to the structure illustrated in FIG. 1. For example, an electrode tip may be formed in the part where the gap g is formed in the center electrode 20. As a material of the electrode tip, an alloy containing noble metal such as iridium or platinum may be used. The core material 22 of the center electrode 20 may be omitted.

Although the present invention has been described above based on the embodiments and modifications, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5: gasket
6: second packing
7: third packing
8: first packing
9: talc
10: insulator
11: second reduced outer diameter portion
12: axial hole
13: leg portion¥
15: first reduced outer diameter portion
16: reduced inner diameter portion
17: first trunk portion
18: second trunk portion
19: flange portion
20: center electrode
20*s*1: discharge surface
21: electrode base material
22: core material
23: head portion
24: flange portion
25: leg portion
30, 30*b*: ground electrode
33: ground electrode base material
33*x*: ground electrode base material
33*s*1: first surface
33*s*2: second surface
38: ground electrode tip
38*s*1: discharge surface
38*s*2: large diameter surface
39: fixing member
39*s*1: rear end face
39*s*2: front end face
39*s*3: outer surface
40: metal terminal
41: cap mounting portion
42: flange portion
43: leg portion
50: metal shell
51: tool engagement portion
52: screw portion
53: crimp portion
54: seat portion
55: trunk portion
56: reduced inner diameter portion
58: deformation portion
59: insertion hole
60: first sealing portion
70: resistor
80: second sealing portion
82: melt portion
100: ignition plug
331, 331*b*: front end portion
332: connection end
333: free end
335: through hole
335*a*: small diameter portion
335*b*: large diameter portion
335*c*: step portion
381: tip body
381*s*: outer surface
382: flange portion
g: gap
LD: front end direction
BD: rear end direction
FD: free end direction
CD: connection end direction
BL: boundary
CL: axial line
HL: recess portion
PT1: first portion
PT2: second portion Having described the invention, the following is claimed:

1. An ignition plug comprising:

a center electrode;

a ground electrode base material having a first surface facing the center electrode and a second surface which is a reverse face of the first surface, and having a through hole which penetrates from the first surface to the second surface, the through hole having a first diameter in the first surface and a second diameter in the second surface that is larger than the first surface;

a ground electrode tip forming a gap between the ground electrode tip and the center electrode, having a discharge surface which has a diameter smaller than the first diameter, having a large diameter surface which has a diameter larger than the first diameter and smaller than the second diameter and which is a reverse face of the discharge surface, having a part including the large diameter surface disposed in the through hole, the discharge surface being exposed to the center electrode side from the through hole; and a fixing member disposed in the through hole at a part on a second direction side with respect to the large diameter surface when the direction from the large diameter surface to the discharge surface is defined as a first direction and an opposite direction thereto is defined as the second direction, wherein the ground electrode tip is held by an inner surface of the ground electrode base material, the inner surface forming the through hole, and by a surface on the first direction side of the fixing member, a maximum length along the first direction of a part of the fixing member, the part being disposed in the through hole, is not less than 50% of a maximum length along the first direction of a part of the ground electrode base material, the part having the through hole formed therein, a melt portion is provided in such a manner that it extends over the ground electrode base material and the fixing member in a cross section which passes through the central axis of the fixing member and extends along the first direction, and in the cross section, a length along the first direction from an end, at the first direction side, of the melt portion in a boundary between the ground electrode base material and the fixing member to the second surface is not less than 50% of the maximum length along the first direction of the part of the fixing member, the part being disposed in the through hole.

2. The ignition plug according to claim 1, wherein the ground electrode tip has a tip body which includes the discharge surface, and a flange portion which has a diameter larger than that of the tip body, which is located at the second direction side with respect to the tip body, and which includes the large diameter surface, the through hole includes a small diameter portion which has a diameter larger than that of the discharge surface and smaller than that of the flange portion, and a large diameter portion which is located at the second direction side with respect to the small diameter portion and which has a diameter larger than that of the flange portion, the ground electrode base material has a step portion formed between the small diameter portion and the large diameter portion in the through hole, and a surface at the first direction side of the flange portion is supported by the step portion.

3. The ignition plug according to claim 2, wherein a percentage of a diameter of an end, in the second direction, of the tip body relative to a diameter of the flange portion is not less than 76% and not more than 95%.

4. The ignition plug according to claim 1, further comprising:

an insulator configured to hold the center electrode; and a metal shell disposed around the insulator in a radial direction thereof, wherein the ground electrode base material has a connection end that is connected to the metal shell, and the melt portion at a position that intersects with a virtual line extending in a direction from the center of the ground electrode tip toward the connection end reaches the ground electrode tip.

5. The ignition plug according to claim 2, further comprising:

an insulator configured to hold the center electrode; and a metal shell disposed around the insulator in a radial direction thereof, wherein the ground electrode base material has a connection end that is connected to the metal shell, and the melt portion at a position that intersects with a virtual line extending in a direction from the center of the ground electrode tip toward the connection end reaches the ground electrode tip.

6. The ignition plug according to claim 3, further comprising:

an insulator configured to hold the center electrode; and a metal shell disposed around the insulator in a radial direction thereof, wherein the ground electrode base material has a connection end that is connected to the metal shell, and the melt portion at a position that intersects with a virtual line extending in a direction from the center of the ground electrode tip toward the connection end reaches the ground electrode tip.

7. The ignition plug according to claim 4, wherein the ground electrode base material has a free end, at a side opposite to the connection end, which is not connected with the metal shell, and the melt portion at a position that intersects with a virtual line extending in a direction from the center of the ground electrode tip to the free end does not reach the ground electrode tip.

8. The ignition plug according to claim 5, wherein the ground electrode base material has a free end, at a side opposite to the connection end, which is not connected with the metal shell, and the melt portion at a position that intersects with a virtual line extending in a direction from the center of the ground electrode tip to the free end does not reach the ground electrode tip.

9. The ignition plug according to claim 6, wherein the ground electrode base material has a free end, at a side opposite to the connection end, which is not connected with the metal shell, and the melt portion at a position that intersects with a virtual line extending in a direction from the center of the ground electrode tip to the free end does not reach the ground electrode tip.

10. The ignition plug according to claim 1, wherein the ground electrode tip is either one of iridium, and an iridium alloy.

11. The ignition plug according to claim 2, wherein the ground electrode tip is either one of iridium, and an iridium alloy.

12. The ignition plug according to claim 3, wherein the ground electrode tip is either one of iridium, and an iridium alloy.

13. The ignition plug according to claim 4, wherein the ground electrode tip is either one of iridium, and an iridium alloy.

14. The ignition plug according to claim 5, wherein the ground electrode tip is either one of iridium, and an iridium alloy.

15. The ignition plug according to claim 6, wherein the ground electrode tip is either one of iridium, and an iridium alloy.

16. The ignition plug according to claim 7, wherein the ground electrode tip is either one of iridium, and an iridium alloy.

17. The ignition plug according to claim 8, wherein the ground electrode tip is either one of iridium, and an iridium alloy.

18. The ignition plug according to claim 9, wherein the ground electrode tip is either one of iridium, and an iridium alloy.

* * * * *